US010859024B2

(12) United States Patent
Russe et al.

(10) Patent No.: US 10,859,024 B2
(45) Date of Patent: Dec. 8, 2020

(54) DETERMINING THE OPENING ENERGY OF A FUEL INJECTOR

(71) Applicant: Continental Automotive GmbH, Hannover (DE)

(72) Inventors: Peter-Matthias Russe, Tegernheim (DE); Hans-Joerg Wiehoff, Regensburg (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 198 days.

(21) Appl. No.: 14/768,033

(22) PCT Filed: Mar. 27, 2014

(86) PCT No.: PCT/EP2014/056109
§ 371 (c)(1),
(2) Date: Aug. 14, 2015

(87) PCT Pub. No.: WO2014/154779
PCT Pub. Date: Oct. 2, 2014

(65) Prior Publication Data

US 2016/0003183 A1 Jan. 7, 2016

(30) Foreign Application Priority Data

Mar. 27, 2013 (DE) ..... 10 2013 205 504

(51) Int. Cl.
*F02D 41/24* (2006.01)
*F02D 41/20* (2006.01)
*F02D 41/08* (2006.01)

(52) U.S. Cl.
CPC ..... *F02D 41/2467* (2013.01); *F02D 41/2096* (2013.01); *F02D 41/247* (2013.01); *F02D 41/2438* (2013.01); *F02D 41/08* (2013.01)

(58) Field of Classification Search
CPC ..... F02D 41/2467; F02D 41/2438; F02D 41/247; F02D 41/08
(Continued)

(56) References Cited

U.S. PATENT DOCUMENTS 7,406,861 B2 8/2008 Jung et al. ..... 73/114.51
9,097,198 B2 8/2015 Budiscak et al. ..... F02D 41/247
(Continued)

FOREIGN PATENT DOCUMENTS

DE 4312587 A1 10/1994
DE 19945618 A1 3/2001
(Continued)

OTHER PUBLICATIONS

German Office Action, Application No. 102013205504.8, 6 pages, dated Nov. 8, 2013.
(Continued)

*Primary Examiner* — Lindsay M Low
*Assistant Examiner* — Omar Morales
(74) *Attorney, Agent, or Firm* — Slayden Grubert Beard PLLC

(57) ABSTRACT

A method for determining the opening energy of a fuel injector of an internal combustion engine includes (a) operating the engine in a steady-state operating state, wherein electrical excitation is applied to the fuel injector to cause a fuel injection in each working cycle of the engine, (b) applying additional electrical excitation to the fuel injector for subsequent working cycle(s) for a possible additional partial fuel injection, wherein the additional electrical excitation is initially insufficient to cause an additional partial fuel injection, (c) successively increasing the additional electrical excitation until an additional partial fuel injection occurs, which brings about a second operating state of the engine different from the steady-state operating state, (d)
(Continued)

detection of the second operating state, and (e) determination of the opening energy for the fuel injector based on the energy of the additional electrical excitation needed to bring about the second operating state of the engine.

17 Claims, 1 Drawing Sheet

(58) Field of Classification Search
USPC ..... 701/103
See application file for complete search history.

(56) References Cited

U.S. PATENT DOCUMENTS

| | | | | |
|---|---|---|---|---|
| 2003/0130784 | A1* | 7/2003 | Peltier | F02B 61/045 701/104 |
| 2010/0286894 | A1* | 11/2010 | Jung | F02D 41/009 701/106 |
| 2013/0046454 | A1* | 2/2013 | Cowgill | F02D 19/024 701/104 |

FOREIGN PATENT DOCUMENTS

| | | | |
|---|---|---|---|
| DE | 102004044450 | B3 | 4/2006 |
| DE | 102006015968 | B3 | 11/2007 |
| DE | 102008043165 | A1 | 4/2010 |
| DE | 102011006915 | A1 | 10/2012 |
| EP | 2108804 | A1 | 10/2009 |
| GB | 2277173 | A | 10/1994 |
| WO | 2014/154779 | A1 | 10/2014 |

OTHER PUBLICATIONS

International Search Report and Written Opinion, Application No. PCT/EP2014/056109, 14 pages, dated Jun. 3, 2014.
Korean Office Action, Application No. 2017008581882, 8 pages, dated Feb. 2, 2017.
Chinese Office Action, Application No. 201480014491.3, 14 pages, dated Apr. 28, 2017.

* cited by examiner

DETERMINING THE OPENING ENERGY OF A FUEL INJECTOR

CROSS-REFERENCE TO RELATED APPLICATIONS

This application is a U.S. National Stage Application of International Application No. PCT/EP2014/056109 filed Mar. 27, 2014, which designates the United States of America, and claims priority to DE Application No. 10 2013 205 504.8 filed Mar. 27, 2013, the contents of which are hereby incorporated by reference in their entirety.

TECHNICAL FIELD

The present invention relates generally to the technical field of the drive of fuel injectors for injecting fuel into the combustion chamber of an internal-combustion engine. The present invention relates, in particular, to a method, to an engine management system and also to a computer program for determining the opening energy of a fuel injector of an internal-combustion engine, which opening energy is at least required in order to open the fuel injector at least partly.

BACKGROUND

Directly driven injection fuel injectors lift a needle out of its seat by electrical energization of a coil drive or of a piezoelectric transducer, and consequently clear nozzle holes for the flow of fuel. The more electrical energy is supplied to the fuel injector, the further the needle opens. If the electrical energy is less than the so-called opening energy of the fuel injector in question, this energy is not sufficient to raise the needle.

As a result of production tolerances, aging effects and varying environmental conditions, the opening energy may vary individually for each fuel injector. However, in order to achieve high quantitative accuracy, particularly in the course of the injection of small amounts of fuel, for example in so-called ballistic operation of the fuel injector, or in the case of multiple injections with very minor partial injections, as accurate a knowledge as possible of the opening energy that is specific to the fuel injector is required.

SUMMARY

One embodiment provides a method for determining the opening energy of a fuel injector of an internal-combustion engine, which opening energy is at least required in order to open the fuel injector at least partly, the method comprising operating the internal-combustion engine in a non-transient first operating state, wherein in each working cycle of the internal-combustion engine the fuel injector is subjected to an electrical excitation that results in an injection of fuel, additional subjecting of the fuel injector, for at least one of the following working cycles, to an additional electrical excitation that has been assigned to a possible additional partial injection of fuel, wherein the additional electrical excitation is firstly still so weak that effectively no additional partial injection of fuel occurs, successive increasing of the energy of the additional electrical excitation for the at least one following working cycle until an additional partial injection of fuel by the fuel injector occurs, wherein the additional partial injection then results in a second operating state of the internal-combustion engine, which is different from the non-transient first operating state, detecting the second operating state of the internal-combustion engine and determining the opening energy for the fuel injector on the basis of the energy of the additional electrical excitation that was required in order to change the operating state of the internal-combustion engine to the second operating state.

In a further embodiment, the detecting of the second operating state of the internal-combustion engine includes a detecting of a change in a correcting variable in an engine management system of the internal-combustion engine.

In a further embodiment, the engine management system includes a speed regulator which sets the correcting variable in such a manner that the speed of the internal-combustion engine remains at least approximately constant.

In a further embodiment, the successive increasing of the energy of the additional electrical excitation for the at least one following working cycle comprises: (a) operating the internal-combustion engine in a first phase for a first predetermined number of working cycles with an additional electrical excitation having a first energy, (b) operating the internal-combustion engine in a second phase for a second predetermined number of following working cycles without an additional electrical excitation, (c) operating the internal-combustion engine in a third phase for a third predetermined number of working cycles with an additional electrical excitation having a third energy, which is greater than the first energy, and (d) repeating steps (a) and (c) until the additional partial injection of fuel by the fuel injector occurs.

In a further embodiment, for the purpose of detecting the transition from the non-transient first operating state to the second operating state within various phases of the operation of the internal-combustion engine in each instance an averaging is carried out of a physical observable that is indicative of the operating state of the internal-combustion engine.

In a further embodiment, the transition from the non-transient first operating state to the second operating state is detected on the basis of the change in a cross-correlation function, wherein the cross-correlation function for each point in time results from the product of the correcting variable and the energy of the additional electrical excitation.

In a further embodiment, the method further includes: after the detecting of the second operating state of the internal-combustion engine, successive reducing of the energy of the additional electrical excitation for at least one following working cycle until the additional partial injection of fuel by the fuel injector ceases again and the internal-combustion engine is again operated in the non-transient first operating state, detecting the non-transient first operating state of the internal-combustion engine, and renewed determining of the opening energy for the fuel injector on the basis of the energy of the additional electrical excitation, which is just so small that the additional partial injection of fuel by the fuel injector ceases again and the internal-combustion engine passes over again into the non-transient first operating state.

In a further embodiment, the method further includes determining a current intensity of the additional electrical excitation that results in the additional partial injection of fuel by the fuel injector, and calculating the time at which the fuel injector begins to open after the start of the additional electrical excitation, on the basis of (i) the determined current intensity of the additional electrical excitation and (ii) the capacitance of a piezoelectric capacitive drive of the fuel injector.

Another embodiment provides a method for determining the individual opening energies of a plurality of fuel injectors of an internal-combustion engine, wherein the method disclosed above is implemented simultaneously for the plurality of fuel injectors, the determined opening energy that was required in order to change the operating state of the internal-combustion engine to the second operating state is identified as that opening energy which constitutes the least opening energy of the plurality of individual opening energies, and the method disclosed above is implemented individually in succession for each of the plurality of fuel injectors, wherein the energy of the additional electrical excitation for the at least one following working cycle is successively increased, starting from the determined least opening energy.

Another embodiment provides an engine management system for determining the opening energy of a fuel injector of an internal-combustion engine, wherein the engine management system has been configured to execute any of the methods discussed above.

Another embodiment provides a computer program for determining the opening energy of a fuel injector of an internal-combustion engine, wherein the computer program is stored in non-transitory computer-readable media and executable by the processor to implement any of the methods discussed above.

BRIEF DESCRIPTION OF THE DRAWINGS

Example embodiments are discussed below with reference to the drawings, in which.

DETAILED DESCRIPTION

Figure 1:
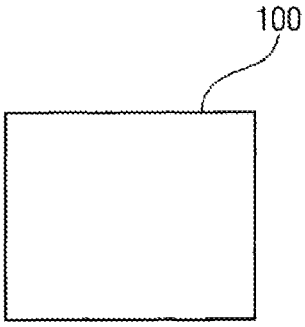
FIG. 1 shows, in a schematic representation, an engine management system for an internal-combustion engine of a motor vehicle.

Embodiments of the invention provide a method and also an apparatus with which the opening energy of a fuel injector of an internal-combustion engine can be determined simply and accurately.

One embodiment provides a method for determining the opening energy of a fuel injector of an internal-combustion engine, wherein the opening energy is that energy which is at least required in order to open the fuel injector at least partly. The described method comprises: (a) operating the internal-combustion engine in a non-transient first operating state, wherein in each working cycle of the internal-combustion engine the fuel injector is subjected to an electrical excitation that results in an injection of fuel, (b) additional subjecting of the fuel injector, for at least one of the following working cycles, to an additional electrical excitation that has been assigned to a possible additional partial injection of fuel, wherein the additional electrical excitation is firstly still so weak that effectively no additional partial injection of fuel occurs, (c) successive increasing of the energy of the additional electrical excitation for the at least one following working cycle until an additional partial injection of fuel by the fuel injector occurs, wherein the additional partial injection then results in a second operating state of the internal-combustion engine, which is different from the non-transient first operating state, (d) detecting the second operating state of the internal-combustion engine and (e) determining the opening energy for the fuel injector on the basis of the energy of the additional electrical excitation that was required in order to change the operating state of the internal-combustion engine to the second operating state.

The perception underlying the described method is that by a successive increase of the energy of an additional electrical excitation which, starting from a certain level, results in an additional partial injection of fuel by the fuel injector, the opening energy that is specific to the respective fuel injector can be determined simply and effectively. This individual opening energy may, in particular, correspond exactly to that energy of the additional electrical excitation which is just required in order actually to result in an additional partial injection of fuel by the fuel injector, and hence in a change of the operating state of the internal-combustion engine.

The electrical energy can be determined by an integration of the power (voltage U×current I) over time.

The operating state of the internal-combustion engine may have been defined by the value of an arbitrary physical observable, which value is characteristic of the combustion of fuel in the internal-combustion engine. A change of the operating state from the non-transient first operating state to the second operating state is therefore distinguished by a change in the value of the corresponding physical observable. The operating state of the internal-combustion engine may, in particular, have been determined (a) by the pressure (pattern) in a cylinder of the internal-combustion engine, (b) by the amount of fuel injected by the fuel injector in question, (c) by the torque generated by the internal-combustion engine and/or (d) by the current speed of the internal-combustion engine. Attention is drawn to the fact that this list is not exhaustive and that other observables that are indicative of the combustion of fuel can also be used for detecting the change of the operating state.

The internal-combustion engine in the non-transient first operating state is preferably running idle. The idling speed may be, for example, 800 rpm. Hence the described method can be executed during conventional operation of the internal-combustion engine whenever the internal-combustion engine is just idling. Hence the opening energy of the fuel injector in question can be re-determined again and again, for example when the motor vehicle in question is having to stop at traffic lights. Hence changes in the opening energy during the lifetime of the fuel injector can be detected individually for each fuel injector. Aging effects that have an influence on the opening energy can then be compensated for future working cycles by a suitable drive of the fuel injector in question. Hence the quantitative accuracy can be improved, particularly in the case of the injection of very small amounts.

By the term "working cycle", in known manner a working period of a four-stroke reciprocating-piston engine is to be understood. This working period comprises: (a) an intake stroke, (b) a compression and ignition stroke, (c) a power stroke and (d) an exhaust stroke.

According to one embodiment, the detecting of the second operating state of the internal-combustion engine includes a detecting of a change in a correcting variable in an engine management system of the internal-combustion engine. This has the advantage that no separate sensorics are required for the detection of the change of the operating state of the internal-combustion engine. Hence the described method can be realized without additional expenditure on hardware. Merely a suitable programming of the engine management system of the internal-combustion engine is required.

According to another embodiment of the invention, the engine management system includes a speed regulator which sets the correcting variable in such a manner that the speed of the internal-combustion engine remains at least approximately constant.

The correcting variable may be, for example, the torque of the internal-combustion engine. If the energy of the additional electrical excitations becomes so great that an additional partial injection of fuel by the fuel injector occurs (transition from the first non-transient operating state to the second operating state), then a somewhat increased amount of fuel per working cycle is injected overall, resulting initially in an increased torque. In order to compensate for this, the speed regulator has to down-regulate the correcting variable constituted by the torque. Accordingly, the transition from the first non-transient operating state to the second operating state is distinguished, according to the embodiment represented herein, by a change in the correcting variable constituted by the torque.

According to another embodiment, the successive increasing of the energy of the additional electrical excitation for the at least one following working cycle comprises the following steps: (a) operating the internal-combustion engine in a first phase for a first predetermined number of working cycles with an additional electrical excitation having a first energy, (b) operating the internal-combustion engine in a second phase for a second predetermined number of following working cycles without an additional electrical excitation, (c) operating the internal-combustion engine in a third phase for a third predetermined number of working cycles with an additional electrical excitation having a third energy, which is greater than the first energy, and (d) repeating steps (a) and (c) until the additional partial injection of fuel by the fuel injector occurs.

Expressed descriptively, this means that during the phase of the successive increasing of the energy of the additional electrical excitation the additional electrical excitation is activated alternately for a first and third predetermined number of working cycles and then deactivated for a predetermined second predetermined number of working cycles. In this way, in each instance for a predetermined number of working cycles the additional electrical excitation is alternately activated or deactivated. In the process, the energy is successively increased with each new phase in which the additional electrical excitation has been activated.

The first and the third predetermined number may preferably be of the same magnitude. This means that the phases in which the additional electrical excitation has been activated are the same length in terms of the number of working cycles.

The first or third and the second predetermined number may also be of the same magnitude. This means that the immediately consecutive phases of the operation of the internal-combustion engine (a) with additional electrical excitation and (b) without additional electrical excitation are the same length in terms of the number of working cycles.

With regard to the exact magnitude of the various predetermined numbers of working cycles in the various phases of the operation of the internal-combustion engine there are no special defaults. It should, however, be noted that the period of time within which the energy of the additional electrical excitation is successively increased gets longer with a predetermined number of working cycles, since each single phase of the operation of the internal-combustion engine lasts longer. On the other hand, a larger predetermined number of working cycles reduces the probability that the transition from the non-transient first operating state to the second operating state is not detected correctly, for example as a consequence of fluctuations of, or a noise in, the observable that is to indicate this transition.

A good compromise between these two aspects as regards the respective predetermined number currently appears to be that the first, the second and/or the third predetermined number lies between 2 and 10, in particular between 4 and 8, or is preferentially 5.

According to another embodiment, for the purpose of detecting the transition from the non-transient first operating state to the second operating state within various phases of the operation of the internal-combustion engine in each instance an averaging is carried out of a physical observable that is indicative of the operating state of the internal-combustion engine. This has the advantage that statistical fluctuations of, or a noise in, the physical observable are averaged out. Hence the described method becomes particularly reliable.

As already elucidated above, depending on the special application the physical observable can be selected from a plurality of theoretically possible physical observables. At the present time it appears to be particularly preferred to use as physical observable a response of a speed regulator to the additional torque that is generated as a consequence of the additional partial injection in the second operating state. In order to maintain a certain speed (in particular, the idling speed), the correcting variable of the speed regulator, which is indicative of a certain torque for example, is changed appropriately when the additional partial injection obtains. In the corresponding regulating signal of the speed regulator the correcting variable "torque" will then show a negative change at the transition to the second operating state.

According to another embodiment, the transition from the non-transient first operating state to the second operating state is detected on the basis of the change in a cross-correlation function, wherein the cross-correlation function for each point in time results from the product of the correcting variable and the energy of the additional electrical excitation.

The temporal progression of the energies of the additional electrical excitations shows a progression of discrete pulses in the course of the stepwise increase, described above, of the energy of the additional excitations, wherein prior to any increase the additional electrical excitation is deactivated or set to zero for a second predetermined number of working cycles. In this connection, the pulse width has been determined by the first predetermined number or by the third predetermined number of working cycles. Correspondingly, the spacing between two consecutive pulses has been determined by the second predetermined number of working cycles, within which the additional electrical excitation has been deactivated. The height of the discrete pulses is indicative of the energy of the respective additional excitations.

The described use of the cross-correlation function has the advantage that the transition between the non-transient first operating state and the second operating state can be detected particularly reliably. The reliability of the detection of this transition on the basis of the cross-correlation function is particularly high if the cross-correlation function is used in a logarithmic scaling. The transition between the non-transient first operating state and the second operating state can be detected particularly precisely in the logarithmically plotted cross-correlation function on the basis of a step appearing.

According to another embodiment, the method further includes: (a) after the detecting of the second operating state of the internal-combustion engine, successive reducing of the energy of the additional electrical excitation for at least one following working cycle until the additional partial injection of fuel by the fuel injector ceases again and the internal-combustion engine is again operated in the non-transient first operating state, (b) detecting the non-transient first operating state of the internal-combustion engine, and (c) renewed determining of the opening energy for the fuel injector on the basis of the energy of the additional electrical excitation, which is just so small that the additional partial injection of fuel by the fuel injector ceases again and the internal-combustion engine passes over again into the non-transient first operating state.

This means, expressed descriptively, that the energy of the additional electrical excitation approaches the actual opening energy iteratively from different sides. Accordingly, if the second operating state was attained then the actual opening energy can be approached from above with (now smaller) steps. The transition back to the non-transient first operating state then describes even more accurately the opening energy of the fuel injector in question.

Of course, the accuracy can be improved further if, after the "re-attaining" of the non-transient first operating state, the actual opening energy is again approached from below with (now even smaller) steps. The renewed transition to the second operating state then describes, with even greater accuracy, the opening energy of the fuel injector in question.

Another embodiment provides another method for determining the individual opening energies of a plurality of fuel injectors of an internal-combustion engine. (a) With this method, the method described above is implemented simultaneously for the plurality of fuel injectors. (b) Furthermore, the determined opening energy that was required in order to change the operating state of the internal-combustion engine to the second operating state is identified as that opening energy which constitutes the least opening energy of the plurality of individual opening energies. (c) After this, the method described above is implemented individually in succession for each of the plurality of fuel injectors, wherein the energy of the additional electrical excitation for the at least one following working cycle is successively increased, starting from the determined least opening energy.

The perception underlying the described method for determining the individual opening energies of a plurality of fuel injectors is that the method described above for determining the opening energy of an individual fuel injector can firstly be applied collectively for a plurality of fuel injectors and preferably for all the fuel injectors of an internal-combustion engine. In the course of the successive increasing of the energy of the additional electrical excitation, the operating state of the entire internal-combustion engine will change precisely when, as a consequence of the additional electrical excitation which is becoming more intense, the first of the plurality of fuel injectors actually implements an additional partial injection. In the course of the following determination of the individual opening energy for the separate fuel injectors, the opening energy identified as the least opening energy is then used as offset value for all the fuel injectors. Hence the method can be executed more quickly, since each successive increasing of the energy of the additional electrical excitation begins not at a much too small value but rather already at the offset value (=least opening energy of all the opening energies), and hence the individual opening energy for each single fuel injector is attained more quickly.

According to another embodiment, the method further includes: (a) a determination of a current intensity of the additional electrical excitation that results in the additional partial injection of fuel by the fuel injector, and (b) a calculation of the time at which the fuel injector begins to open after the start of the additional electrical excitation, on the basis of (i) the determined current intensity of the additional electrical excitation and (ii) the capacitance of a piezoelectric capacitive drive of the fuel injector.

The time at which the fuel injector begins to open after the start of the additional electrical excitation and which is frequently also designated as OPP1 can preferably be calculated on the basis of the following generally known physical relationship:

$$E=0.5\cdot Q\cdot U=0.5\cdot(I\cdot OPP1)\hat{}2/\mathrm{Cpiezo}$$

where: Q is the charge of the piezoelectric capacitive drive, U is the voltage applied to the piezoelectric capacitive drive, I is the determined current intensity of the additional electrical excitation, OPP1 is the time at which the fuel injector begins to open after the start of the additional electrical excitation, and Cpiezo is the typically previously known capacitance of a piezoelectric capacitive drive of the fuel injector.

According to a further aspect, an engine management system is described for determining the opening energy of a fuel injector of an internal-combustion engine. The described engine management system has been configured to execute one of the methods described above.

The perception underlying the described engine management system is that the method described above can be executed without additional hardware such as special sensors, for example. It is merely necessary to modify an engine management system of an internal-combustion engine, which is already present anyway, to the effect that said system induces an implementation of the method described above. The modification of the engine management system can, for example, be undertaken by means of suitable programming.

Another embodiment provides a computer program for determining the opening energy of a fuel injector of an internal-combustion engine. When it is executed by a processor, the computer program has been configured to implement one of the methods described above.

In the sense of this document, the mention of such a computer program is tantamount to the concept of a program element, computer-program product and/or computer-readable medium that contains instructions for controlling a computer system in order to coordinate the mode of operation of a system or method suitably in order to achieve the effects associated with the method according to the invention.

The computer program may have been implemented as computer-readable instruction code in any suitable programming language such as, for example, Java, C++ etc. The computer program may have been stored on a computer-readable storage medium (CD-ROM, DVD, Blu-ray disc, interchangeable drive assembly, volatile or non-volatile memory, built-in memory/processor, etc.). The instruction code can program a computer or other programmable devices—such as, in particular, a control device for an engine of a motor vehicle—in such a manner that the desired functions are executed. Furthermore, the computer program can be provided in a network, such as the Internet for example, from which it can be downloaded by a user on demand.

Embodiments of the invention can be realized both by means of a computer program, i.e. software, and by means of one or more special electronic circuits, i.e. in hardware, or in arbitrarily hybrid form, i.e. by means of software components and hardware components.

Attention is drawn to the fact that embodiments of the invention were described with reference to varying subject-matters of the invention. To a person skilled in the art, however, it will immediately become clear upon reading this application that, unless explicitly stated otherwise, in addition to a combination of features that pertain to one type of subject-matter of the invention, an arbitrary combination is also possible of features that pertain to varying types of subject-matter of the invention.

Attention is drawn to the fact that the embodiments described below represent merely a limited selection of possible practical variants of the invention. In particular, it is possible to combine the features of separate embodiments suitably with one another so that with the practical variants represented explicitly herein a plurality of different embodiments are to be regarded as obviously disclosed for a person skilled in the art.

FIG. 1 shows, in a schematic representation, an engine management system 100 for an internal-combustion engine of a motor vehicle. The engine management system 100 has been programmed to implement the method described below for determining the opening energy of a fuel injector of the internal-combustion engine.

The method elucidated below on the basis of FIG. 2 utilizes the speed response at a non-transient operating point of the internal-combustion engine, for example when idling, to systematic excitation discontinuities or to the blending-in of an identifiable pattern capable of being differentiated well from the noise. The excitation discontinuities and the distinguishable and identifiable pattern are represented at the top in FIG. 2. Plotted as a function of time, which has been specified here in the form of sampling steps, is the additional electrical excitation of the fuel injector, which, starting from a certain level, results in an additional partial injection in each working cycle of the internal-combustion engine. The additional electrical excitation is plotted in the unit mJ as additional excitation energy for each working cycle. In the representation shown in FIG. 2, four sampling steps correspond to one working cycle of the internal-combustion engine.

Figure 2:
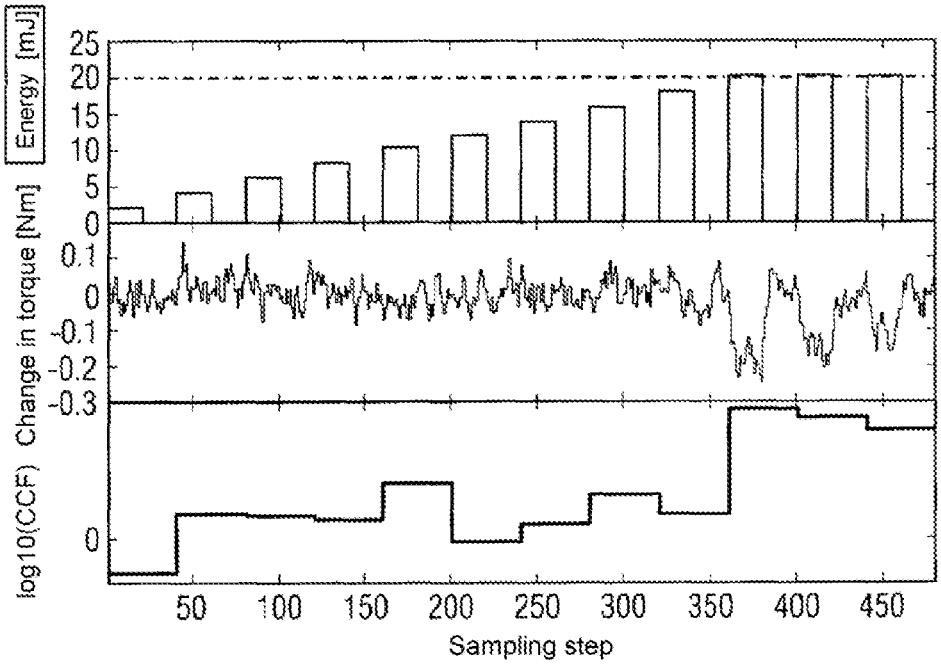
FIG. 2 shows a simulated signal progression for determining the opening energy of a fuel injector in the case of a single-cylinder four-stroke engine.

As evident in FIG. 2, according to the embodiment represented here additional electrical excitations becoming more intense are switched to all the fuel injectors, starting from a stable operating point (here, idling of the internal-combustion engine). According to the embodiment represented here, these additional electrical excitations are activated in each instance for 5 working cycles and then deactivated for a further 5 working cycles. After this, the alternating activating and deactivating of the additional electrical excitation is continued with a somewhat more intense additional electrical excitation. The alternating activating and deactivating of the additional electrical excitation with additional electrical excitation becoming more intense is continued until such time as, starting from a certain additional electrical excitation or from a certain additional electrical energy, the speed of the internal-combustion engine reacts to the temporal progression of the electrical excitation. As soon as this is the case, in the case of an internal-combustion engine with several fuel injectors this procedure can be implemented for each fuel injector individually. The energy discontinuity or the additional electrical energy at which the speed of the internal-combustion engine has reacted for the first time to the electrical excitation discontinuities can then be used as starting offset for a subsequent determination, specific to the fuel injector, of the opening energy, starting from which offset the additional electrical excitation or the additional electrical energy is increased. The offsets of the fuel injectors not to be adapted in the given case may in this connection be kept constant.

In an embodiment currently appearing to be particularly suitable, the speed-regulated idling operation of the internal-combustion engine is used as non-transient operating point. The idling regulator of the engine management system of the internal-combustion engine includes, amongst other things, an integral-mode regulator. The correcting value of said integral-mode regulator decreases if the additional electrical excitation assigned to a possible additional partial injection exceeds the opening energy that is specific to the fuel injector, and additional fuel is actually injected.

According to the embodiment represented here, the correcting variable of the integral-mode regulator is a control signal which is proportional to the set value of the current torque. If, starting from a certain additional electrical excitation, an additional torque is generated by reason of an additional partial injection of fuel, then the idling regulator will reduce its control signal for the set value of the current torque correspondingly, in order to keep constant the torque generated overall and the speed of the internal-combustion engine. This is shown in the middle diagram of FIG. 2. Starting from an additional energy at a level of 20 mJ, a change in the set value, temporally correlated with the additional electrical excitations, for the torque generated by the internal-combustion engine can be detected, starting from the approximately 360th sampling step. The idling regulator of the engine management system accordingly ensures that the torque generated overall by the internal-combustion engine and hence also the speed of the internal-combustion engine remain constant, despite the additional electrical excitations which, according to the embodiment represented here, starting from a level of 20 mJ result in an additional partial injection of fuel.

In order, against the background of an always noisy control signal of the correcting variable, to increase the reliability of the detection of changes in the set value for the torque to be generated, a cross-correlation function CCF can be evaluated which for any point in time results from the product of the additional energy (plotted in the upper diagram in FIG. 2) and the set value for the torque to be generated (plotted in the middle diagram in FIG. 2). Furthermore, the reliability of the detection of changes in the set value for the torque to be generated can be improved by use being made merely of the integral component which is output by the idling regulator, and not the proportional component, for the calculation of the cross-correlation function CCF from the set value for the torque to be generated. This corresponds then to a smoothing or an averaging over several sampling steps. The period of time over which this smoothing or averaging is undertaken is determined by the time constant of the integral component. The cross-correlation function CCF generated in this way is represented in the lower diagram in FIG. 2. In this diagram it is to be noted that the cross-correlation function CCF is plotted on a logarithmic scale. It can be clearly discerned that, starting from the attaining of the opening energy at approximately the 360th sampling step, the logarithmic value of the cross-correlation function CCF has increased comparatively greatly.

Attention is drawn to the fact that the method, described in this document, for a fuel injector can particularly preferably be employed when this fuel injector no longer opens at all, for example by reason of aging or by reason of a partial defect in the course of a regular electrical excitation, and accordingly also no detection is any longer possible of the times OPP2 and OPP4 at which a valve needle of the fuel injector strikes in its respective end position. In the case of a fuel injector that has become so inert or sluggish, reference is also made in this document to a loss of the possibility of detection of OPP2 and OPP4.

In this context, by "time OPP2" that time in the course of the opening of a fuel injector is to be understood at which, after the start of the electrical excitation of the fuel injector, for example by means of a boost phase, the fuel injector attains its full flow. This means that at time OPP2 the fuel injector is completely open, and that the needle of the fuel injector is located at its upper stop. By "time OPP4", that time in the course of the opening of a fuel injector is to be understood at which the fuel injector is completely closed again after the start of its electrical excitation. A detection of times OPP2 and OPP4 is employed in a known manner in the case of fuel injectors for the purpose of determining the opening behavior thereof and the closing behavior thereof, in order later to drive the fuel injector in question suitably in such a way that a high quantitative accuracy is obtained for the specific fuel injector, particularly in the case of small amounts of fuel to be injected.

After a loss of the possibility of detection of OPP2 and OPP4 (the fuel injector in question no longer opens completely with a conventional excitation curve), with the method described herein the opening energy of the fuel injector can be determined, and the electrical excitation of the fuel injector can be adapted appropriately for future injection processes. In this way, the sluggishness of the fuel injector can be suitably compensated by a more intense electrical excitation.

Furthermore, with the method described herein for fuel injectors a fundamental characteristic as regards their individual opening behavior can be created, and the validity of an existing closed-loop control system can be examined. The ascertained fundamental characteristic can be written back into a non-volatile memory of an engine management system and can be adjusted with current values at a later time. If these values differ considerably, an exchange of the fuel injector in question can be assumed, and a resetting of the corresponding characteristic maps for adaptation can be undertaken.

In the case of a loss of the possibility of detection of OPP2 and OPP4, the correcting variable for the current can be pre-initialized with the average current of the other fuel injectors. If this measure does not result in a recovery of the possibility of detection of OPP2 and OPP4, or an existing closed-loop control system is to be examined, the correcting variable can then be increased and decreased more and more from the initialization by means of a definable scan. A possible current progression is specified in the upper diagram in FIG. 2. In the embodiment represented here, the modeled opening energy amounts to 20.0 mJ. An algorithm of the scan detects a value of 20.1 mJ in the embodiment shown here.

With an algorithm of such a type, via a proportional control a value of the aforementioned cross-correlation function CCF can be obtained that describes the "just open" state of the fuel injector. Too high a CCF value means that the opening energy was exceeded too far. In this case the algorithm can slowly down-regulate the energy of the electrical excitation with a reduced amplification factor.

Summing up, the following remains to be observed: with the application of the method described herein, after a loss of the possibility of the detection of OPP2 and OPP4 the probability can be increased of driving the fuel injector in question, on the basis of the individually determined opening energy, in such a way that there is the possibility of a detection of OPP2 and OPP4 again. Hence, where appropriate, an unnecessary emergency program for protecting the fuel-injector component can be avoided.

Furthermore, by utilizing the possibility of the determination of the individual opening energy, fuel injectors having a greater zero shift or having a higher drift can now be selected for an internal-combustion engine. Furthermore, use may also be made of output stages for engine management systems having a greater tolerance. Hence in the course of the production of the output-stage components for engine management systems and fuel injectors the reject rate can be effectively reduced without any change in the production conditions.

In addition, with the method described herein for determining the opening energy, fuel injectors in the already integrated state can be characterized in terms of their electrical and hydraulic properties. In the case of directly driven injection systems, also for minor or ballistic injection processes in which the needle of the fuel injector is not deflected completely but only with a partial stroke minimally above the opening-point, this makes possible an injection of fuel having high quantitative accuracy.

In addition, by virtue of the determination, specific to the fuel injector, of the opening energy, drive parameters can be learned, adapted and optimized by an engine control device itself. Furthermore, already in the course of the production of fuel injectors the individual opening energy can be determined in an engine test rig. Here, in particular through the application of a cross-correlation function, even very small additional amounts of injected fuel can be detected which normally would not be detectable by reason of unavoidable noise in the case of a technique for measuring the amount of fuel.

What is claimed is:

1. A method for determining a minimum opening energy for a fuel injector of an internal-combustion engine, the method comprising:

operating the internal-combustion engine in a non-transient first operating state, wherein in each working cycle of the internal-combustion engine an electrical excitation that results in an injection of fuel is applied to the fuel injector, in subsequent working cycles of the engine, implementing and analyzing an additional partial injection of fuel by:

applying an additional electrical excitation to the fuel injector, wherein an energy of the additional electrical excitation is initially insufficient to effectively cause the additional partial injection of fuel, successively increasing the energy of the additional electrical excitation in subsequent working cycles until the additional partial injection of fuel by the fuel injector occurs, which additional partial injection changes the operating state from the non-transient first operating state to a second operating state of the internal-combustion engine different from the non-transient first operating state and defined by the additional partial injection of fuel, detecting the second operating state of the internal-combustion engine, and determining the energy of the additional electrical excitation that caused the additional partial injection of fuel to thereby change the operating state of the internal-combustion engine to the second operating state.

2. The method of claim 1, wherein detecting the second operating state of the internal-combustion engine includes detecting a change in a correcting variable in an engine management system of the internal-combustion engine.

3. The method of claim 2, wherein the engine management system includes a speed regulator that sets the correcting variable such that the speed of the internal-combustion engine remains at least approximately constant.

4. The method of claim 1, wherein successively increasing the energy of the additional electrical excitation working cycle comprises:

(a) operating the internal-combustion engine in a first phase for a first predetermined number of working cycles with an additional electrical excitation having a first energy, (b) operating the internal-combustion engine in a second phase for a second predetermined number of following working cycles without an additional electrical excitation, (c) operating the internal-combustion engine in a third phase for a third predetermined number of working cycles with an additional electrical excitation having a third energy, which is greater than the first energy, and (d) repeating steps (a) and (c) until the additional partial injection of fuel by the fuel injector occurs.

5. The method of claim 4, comprising detecting a transition from the non-transient first operating state to the second operating state by calculating an average of a physical observable that is indicative of the operating state of the internal-combustion engine.

6. The method of claim 5, wherein the transition from the non-transient first operating state to the second operating state is detected based on a change in a cross-correlation function, wherein the cross-correlation function for each point in time results from a product of the correcting variable and the energy of the additional electrical excitation.

7. The method of claim 1, further comprising:

after the detecting the second operating state of the internal-combustion engine, successively reducing the energy of the additional electrical excitation until reaching a non-opening energy that is insufficient to cause the additional partial injection of fuel by the fuel injector, thereby causing the internal-combustion engine to change back to the non-transient first operating state, detecting the non-transient first operating state of the internal-combustion engine, and performing a supplementary determination the minimum opening energy for the fuel injector based on the non-opening energy of the additional electrical excitation.

8. The method of claim 1, further including:

determining a current intensity of the additional electrical excitation that results in the additional partial injection of fuel by the fuel injector, and calculating a time at which the fuel injector begins to open after the start of the additional electrical excitation, based on (i) the determined current intensity of the additional electrical excitation and (ii) a capacitance of a piezoelectric capacitive drive of the fuel injector.

9. A method for determining the individual opening energies of a plurality of fuel injectors of an internal-combustion engine, the method comprising:

for each of the plurality of fuel injectors, simultaneously determining a minimum opening energy for the respective fuel injector, wherein determining the minimum opening energy for each respective fuel injector comprises:

operating the internal-combustion engine in a non-transient first operating state, wherein in each working cycle of the internal-combustion engine an electrical excitation that results in an injection of fuel is applied to the respective fuel injector, in subsequent working cycles of the engine, implementing and analyzing an additional partial injection of fuel by:

applying an additional electrical excitation to the respective fuel injector, wherein an energy of the additional electrical excitation is initially insufficient to effectively cause the additional partial injection of fuel, and successively increasing the energy of the additional electrical excitation in subsequent working cycles until the additional partial injection of fuel by the respective fuel injector occurs, which additional partial injection changes the operating state from the non-transient first operating state to a second operating state of the internal-combustion engine different from the non-transient first operating state and defined by the additional partial injection of fuel, detecting the second operating state of the internal-combustion engine, and determining the activation energy of the additional electrical excitation that caused the additional partial injection of fuel and thereby changed the operating state of the internal-combustion engine to the second operating state, identifying the lowest activation energy of the respective minimum opening energies of the plurality of fuel injectors, and subsequently determining a new minimum opening energy for each of the plurality of fuel injectors by applying an initial additional electrical excitation at the identified lowest minimum opening energy and successively increasing the energy of the additional electrical excitation until an additional partial injection of fuel by the respective fuel injector occurs.

10. An engine management system configured to determine a minimum opening energy of a fuel injector of an internal-combustion engine, wherein the engine management system comprises:

a processor, and computer instructions stored in non-transitory computer-readable media and executable by the processor to:

operate the internal-combustion engine in a non-transient first operating state, wherein in each working cycle of the internal-combustion engine an electrical excitation that results in an injection of fuel is applied to the fuel injector, apply an additional electrical excitation to the fuel injector, wherein an energy of the additional electrical excitation is initially insufficient to effectively cause an additional partial injection of fuel, successively increase the energy of the additional electrical excitation in subsequent working cycles until the additional partial injection of fuel by the fuel injector occurs, which additional partial injection changes the operating state from the non-transient first operating state to a second operating state of the internal-combustion engine different from the non-transient first operating state and defined by the additional partial injection of fuel, detect the second operating state of the internal-combustion engine, and determine the energy of the additional electrical excitation that caused the additional partial injection of fuel to thereby change the operating state of the internal-combustion engine to the second operating state.

11. The engine management system of claim 10, wherein detecting the second operating state of the internal-combustion engine includes detecting a change in a correcting variable in an engine management system of the internal-combustion engine.

12. The engine management system of claim 11, wherein the engine management system includes a speed regulator that sets the correcting variable such that the speed of the internal-combustion engine remains at least approximately constant.

13. The engine management system of claim 10, wherein successively increasing the energy of the additional electrical excitation working cycle comprises:

(a) operating the internal-combustion engine in a first phase for a first predetermined number of working cycles with an additional electrical excitation having a first energy, (b) operating the internal-combustion engine in a second phase for a second predetermined number of following working cycles without an additional electrical excitation, (c) operating the internal-combustion engine in a third phase for a third predetermined number of working cycles with an additional electrical excitation having a third energy, which is greater than the first energy, and (d) repeating steps (a) and (c) until the additional partial injection of fuel by the fuel injector occurs.

14. The engine management system of claim 13, wherein the computer instructions are executable to detect a transition from the non-transient first operating state to the second operating state by calculating an average of a physical observable that is indicative of the operating state of the internal-combustion engine.

15. The engine management system of claim 14, wherein the transition from the non-transient first operating state to the second operating state is detected based on a change in a cross-correlation function, wherein the cross-correlation function for each point in time results from a product of the correcting variable and the energy of the additional electrical excitation.

16. The engine management system of claim 10, wherein the computer instructions are further executable to:

after the detecting the second operating state of the internal-combustion engine, successively reduce the energy of the additional electrical excitation until reaching a non-opening energy that is insufficient to cause the additional partial injection of fuel by the fuel injector, thereby causing the internal-combustion engine to change back to the non-transient first operating state, detect the non-transient first operating state of the internal-combustion engine, and perform a supplementary determination the minimum opening energy for the fuel injector based on the non-opening energy of the additional electrical excitation.

17. The engine management system of claim 10, wherein the computer instructions are further executable to:

determine a current intensity of the additional electrical excitation that results in the additional partial injection of fuel by the fuel injector, and calculate a time at which the fuel injector begins to open after the start of the additional electrical excitation, based on (i) the determined current intensity of the additional electrical excitation and (ii) a capacitance of a piezoelectric capacitive drive of the fuel injector.

* * * * *